US008596009B2

(12) United States Patent
Baxter et al.

(10) Patent No.: US 8,596,009 B2
(45) Date of Patent: Dec. 3, 2013

(54) SUSPENDED CEILING SYSTEM, SECURING MEMBERS, AND PROCESS OF INSTALLING A SUSPENDED CEILING SYSTEM

(75) Inventors: Nathan Baxter, Lancaster, PA (US); James R. Waters, Lancaster, PA (US)

(73) Assignee: AWI Licensing Company, Wilmington, DE (US)

( * ) Notice: Subject to any disclaimer, the term of this patent is extended or adjusted under 35 U.S.C. 154(b) by 37 days.

(21) Appl. No.: 13/285,214

(22) Filed: Oct. 31, 2011

(65) Prior Publication Data

US 2012/0102865 A1 May 3, 2012

Related U.S. Application Data

(60) Provisional application No. 61/408,785, filed on Nov. 1, 2010.

(51) Int. Cl.
*E04B 9/18* (2006.01)
*E04B 9/00* (2006.01)

(52) U.S. Cl.
USPC ..... 52/506.06; 52/220.6; 52/479; 52/489.1; 52/506.01; 52/506.07

(58) Field of Classification Search
USPC ..... 52/506.01, 506.05, 506.06, 506.07, 52/506.08, 506.09, 509, 511, 745.05, 52/800.1, 220.6, 290, 384, 385, 386, 479, 52/480, 483.1, 489.1, 489.2, 506.03, 52/506.04, 506.1, 510, 512, 714, 715, 52/716.1, 716.6, 716.7, 716.8, 718.04
See application file for complete search history.

(56) References Cited

U.S. PATENT DOCUMENTS

| | | | | | |
|---|---|---|---|---|---|
| 3,001,001 | A | * | 9/1961 | Bibb | 174/71 R |
| 3,110,373 | A | * | 11/1963 | Adams | 52/783.1 |
| 3,202,077 | A | * | 8/1965 | Lee | 454/301 |
| 3,462,906 | A | * | 8/1969 | Schroyer | 52/478 |
| 3,589,660 | A | * | 6/1971 | Dunckel | 248/343 |
| 3,596,425 | A | * | 8/1971 | Kodaras | 52/665 |
| 3,677,589 | A | * | 7/1972 | Roles | 403/217 |
| 3,708,941 | A | * | 1/1973 | Cuckson | 52/506.08 |
| 3,875,717 | A | * | 4/1975 | Moeller | 52/506.08 |
| 4,027,454 | A | * | 6/1977 | Schuplin | 52/714 |
| 4,448,007 | A | * | 5/1984 | Adams | 52/489.2 |
| 4,463,537 | A | * | 8/1984 | Rodriquez et al. | 52/506.07 |
| 4,471,593 | A | * | 9/1984 | Ragland | 52/489.2 |

(Continued)

FOREIGN PATENT DOCUMENTS

WO WO 2008153993 A1 * 12/2008
WO WO 2012061269 A1 * 5/2012

*Primary Examiner* — Basil Katcheves
*Assistant Examiner* — Rodney Mintz

(57) ABSTRACT

Disclosed is a suspended ceiling system, a securing member, and process of installing a patterned suspended ceiling system. The suspended ceiling system includes a grid system having first members and second members, and at least one substrate which extends below the grid system. The at least one substrate has an exposed surface and a concealed surface, and the at least one substrate has first sides and second sides which extend between the exposed surface and the concealed surface. Securing members attach to the concealed surface proximate the first sides, and the securing members have grid engagement members which secure the at least one substrate to the grid system. The securing members cooperate with the first members and the second members of the grid system to properly position the substrate and the spacing between adjacent at least one substrates is controlled.

10 Claims, 7 Drawing Sheets

(56) References Cited

U.S. PATENT DOCUMENTS 4,479,341 A * 10/1984 Schuplin ..... 52/665
4,494,346 A * 1/1985 Gailey ..... 52/506.07
4,520,607 A * 6/1985 Suckow ..... 52/489.1
4,580,386 A * 4/1986 Hemphill et al. ..... 52/664
4,580,387 A * 4/1986 Rogers ..... 52/665
4,610,562 A * 9/1986 Dunn ..... 403/233
4,621,473 A * 11/1986 Wendt ..... 52/489.2
4,678,487 A * 7/1987 Cadwell et al. ..... 55/385.1
4,715,161 A * 12/1987 Carraro et al. ..... 52/714
4,873,809 A * 10/1989 Paul ..... 52/506.07
4,991,373 A * 2/1991 Shaub ..... 52/715
5,024,034 A * 6/1991 Gailey ..... 52/506.07
5,046,294 A * 9/1991 Platt ..... 52/506.06
5,077,951 A * 1/1992 Baker ..... 52/506.07
5,228,263 A * 7/1993 Vaughn ..... 52/714
5,239,801 A * 8/1993 Adams ..... 52/506.07
5,253,463 A * 10/1993 Witmyer ..... 52/506.07
5,331,785 A * 7/1994 Brak ..... 52/506.1
5,355,646 A * 10/1994 Bischel et al. ..... 52/489.1
5,428,930 A * 7/1995 Bagley et al. ..... 52/506.07
5,482,240 A * 1/1996 Caraher ..... 248/297.51
5,692,346 A * 12/1997 Irvine et al. ..... 52/506.09
5,822,941 A * 10/1998 Kinsella ..... 52/506.05
5,845,447 A * 12/1998 Bodine et al. ..... 52/506.09
5,893,250 A * 4/1999 Benvenuto et al. ..... 52/506.08
5,937,605 A * 8/1999 Wendt ..... 52/506.06
5,979,134 A * 11/1999 Neff ..... 52/506.07
6,145,264 A * 11/2000 Dallaire ..... 52/506.07
6,279,286 B1 * 8/2001 Ichihashi ..... 52/489.1
6,367,220 B1 * 4/2002 Krause et al. ..... 52/512
6,389,771 B1 * 5/2002 Moller ..... 52/506.06
6,438,921 B1 * 8/2002 Moore ..... 52/655.1
6,499,262 B1 * 12/2002 Pinchot et al. ..... 52/273
6,971,210 B2 * 12/2005 Kliegle et al. ..... 52/506.07
7,010,894 B1 * 3/2006 Cappelle ..... 52/480
7,062,886 B2 * 6/2006 Auriemma ..... 52/506.07
7,143,562 B2 * 12/2006 Krantz-Lilienthal et al. ..... 52/506.06
7,225,592 B2 * 6/2007 Davis ..... 52/547
7,251,918 B2 * 8/2007 Reif et al. ..... 52/714
7,398,623 B2 * 7/2008 Martel et al. ..... 52/489.2
7,552,567 B2 * 6/2009 Ingratta et al. ..... 52/506.07
7,574,838 B2 * 8/2009 Maisch et al. ..... 52/506.07
7,578,107 B2 * 8/2009 Platt ..... 52/506.06
7,637,065 B2 * 12/2009 Ahren et al. ..... 52/506.06
7,673,429 B2 * 3/2010 Frecska ..... 52/506.07
7,681,370 B2 * 3/2010 Waters et al. ..... 52/506.08
7,788,875 B2 * 9/2010 Wendt ..... 52/712
7,797,902 B2 * 9/2010 Hikai et al. ..... 52/506.05
7,841,149 B2 * 11/2010 Jahn et al. ..... 52/506.08
7,926,237 B2 * 4/2011 Gerkes et al. ..... 52/506.03
8,006,454 B2 * 8/2011 Jankovec et al. ..... 52/506.07
8,051,618 B2 * 11/2011 Ahren et al. ..... 52/506.07
D674,685 S * 1/2013 Dixon ..... D8/395
8,341,913 B2 * 1/2013 Meres et al. ..... 52/506.06
8,356,454 B2 * 1/2013 Napora et al. ..... 52/747.1
8,453,407 B2 * 6/2013 Tedesco et al. ..... 52/506.06
8,480,048 B2 * 7/2013 Krantz-Lilienthal ..... 248/267
2002/0100248 A1 * 8/2002 D'agata ..... 52/763
2003/0226322 A1 * 12/2003 Platt ..... 52/220.6
2004/0068953 A1 * 4/2004 Sauer ..... 52/506.06
2004/0107657 A1 * 6/2004 Cobb ..... 52/283
2004/0118068 A1 * 6/2004 Kliegle et al. ..... 52/483.1
2004/0144049 A1 * 7/2004 Burken et al. ..... 52/506.01
2004/0172907 A1 * 9/2004 Krantz-Lilienthal et al. ..... 52/506.05
2005/0011154 A1 * 1/2005 Kim ..... 52/506.06
2005/0252156 A1 * 11/2005 Martel et al. ..... 52/714
2005/0252158 A1 * 11/2005 Tamaya ..... 52/716.6
2006/0101744 A1 * 5/2006 Falbaum et al. ..... 52/238.1
2006/0162270 A1 * 7/2006 Maisch et al. ..... 52/506.07
2007/0033902 A1 2/2007 Waters et al.
2007/0113513 A1 * 5/2007 Wendt ..... 52/665
2007/0175142 A1 * 8/2007 Steffy ..... 52/384
2007/0180787 A1 * 8/2007 Fecska ..... 52/506.06
2008/0047213 A1 * 2/2008 Jaic ..... 52/506.06
2008/0047214 A1 * 2/2008 Gerkes et al. ..... 52/506.06
2008/0086962 A1 * 4/2008 Jahn et al. ..... 52/220.6
2008/0155927 A1 * 7/2008 Wendt et al. ..... 52/506.07
2009/0000248 A1 1/2009 Waters et al.
2009/0126303 A1 * 5/2009 Ferge et al. ..... 52/410
2009/0178358 A1 * 7/2009 Boyd ..... 52/489.2
2009/0188175 A1 * 7/2009 Waters et al. ..... 52/74
2010/0050554 A1 * 3/2010 Ahren et al. ..... 52/506.06
2010/0064618 A1 * 3/2010 Boyd ..... 52/506.07
2010/0146885 A1 * 6/2010 Myers et al. ..... 52/220.6
2010/0199594 A1 * 8/2010 Wendt ..... 52/718.04
2010/0229475 A1 * 9/2010 Myers et al. ..... 52/173.1
2010/0257808 A1 * 10/2010 Baxter et al. ..... 52/586.1
2011/0067337 A1 * 3/2011 Jahn et al. ..... 52/506.09
2011/0078970 A1 * 4/2011 Boyd ..... 52/506.07
2011/0162315 A1 * 7/2011 Napora et al. ..... 52/656.9
2012/0023853 A1 * 2/2012 Gerkes et al. ..... 52/506.06
2012/0291397 A1 * 11/2012 Bergman ..... 52/745.21
2013/0042560 A1 * 2/2013 Platt et al. ..... 52/506.06

* cited by examiner

SUSPENDED CEILING SYSTEM, SECURING MEMBERS, AND PROCESS OF INSTALLING A SUSPENDED CEILING SYSTEM

CROSS REFERENCE TO RELATED APPLICATION

This patent application claims the benefit of U.S. Provisional Patent Application Ser. No. 61/408,785 filed on Nov. 1, 2010, and entitled "Suspended Ceiling System", the disclosure of which is hereby incorporated by reference herein in its entirety and made part of the present U.S. utility patent application for all purposes.

FIELD OF THE INVENTION

The present invention relates to suspended ceiling systems, securing members for use with suspended ceiling systems, and processes for installing suspended ceiling systems. More specifically, the present invention relates to suspended ceiling systems including securing members that cooperate with a grid system to control spacing between adjacent substrates.

BACKGROUND OF THE INVENTION

Known T-Bar or other types of lay-in ceiling systems can be used to support and suspend relatively light-weight acoustical panels for use in offices, retail stores and similar commercial settings. Concealed ceiling systems use closely spaced ceiling panels to hide the plenum space above, which can contain wiring, conduit, piping, ductwork, and equipment. While such continuous suspended ceiling systems provide a uniform and acoustically absorbing space, designers, architects and building owners often desire the application of more aesthetically appealing materials, such as heavier metal or wood panels. Designers also desire the creation of ceiling patterns that differ visually from the standard 2'×4' grid pattern, such as using staggered panels of different sizes.

Known heavy panel suspension systems use multiple support cables attached to the overhead structure. These cable systems create difficulty in aligning and positioning adjacent panels, maintaining a predetermined spacing between adjacent panels, and are time consuming to install. These cable systems also require access to the plenum space above the panels in order to remove and reinstall the panels.

A suspended ceiling system, a securing member, and a process for installing such a suspended ceiling system that do not suffer from one or more of the above drawbacks would be desirable in the art.

BRIEF DESCRIPTION OF THE INVENTION

According to an embodiment, a suspended ceiling system includes a grid system having first members and second members, and at least one substrate which extends below the grid system. The at least one substrate has an exposed surface and a concealed surface, and the at least one substrate has first sides and second sides which extend between the exposed surface and the concealed surface. Securing members attach to the concealed surface proximate the first sides, and the securing members have grid engagement members which secure the at least one substrate to the grid system. The securing members cooperate with the first members and the second members of the grid system to properly position the substrate and the spacing between adjacent at least one substrates is controlled.

According to an embodiment, a securing member for a suspended ceiling system includes a grid engagement member configured for securing to a grid system. A positioning member is configured for alignment with the grid system, and a mounting flange is configured for attachment to a substrate. The mounting flange includes at least three support points configured in a triangular relation for attachment to the substrate.

According to an embodiment, a process includes installing a suspended ceiling system. The process includes providing a suspended ceiling system including a grid system having first members and second members, and at least one substrate which extends below the grid system. The at least one substrate has an exposed surface and a concealed surface, and the at least one substrate has first sides and second sides which extend between the exposed surface and the concealed surface. Securing members attach to the concealed surface proximate the first sides, and the securing members have grid engagement members which secure the at least one substrate to the grid system. The process includes cooperating the securing members with the first members and the second members of the grid system to properly position the substrate, and controlling the spacing between adjacent at least one substrates.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a suspended ceiling system, a securing member, and a process of installing a suspended ceiling system. Embodiments of the present disclosure permit self-alignment of the substrate panels, permit cooperation with a grid system to control spacing between adjacent substrates, quick installation of heavier substrate panels into ceiling patterns not previously available, permits the accessibility of any substrate panel in the system without having to disturb other adjacent panels, permits removal and reinstallation of any substrate panel without the need for access to the plenum space above the ceiling system, and permits vertical offset of the panels without failure under seismic conditions, and combinations thereof.

Figure 1:
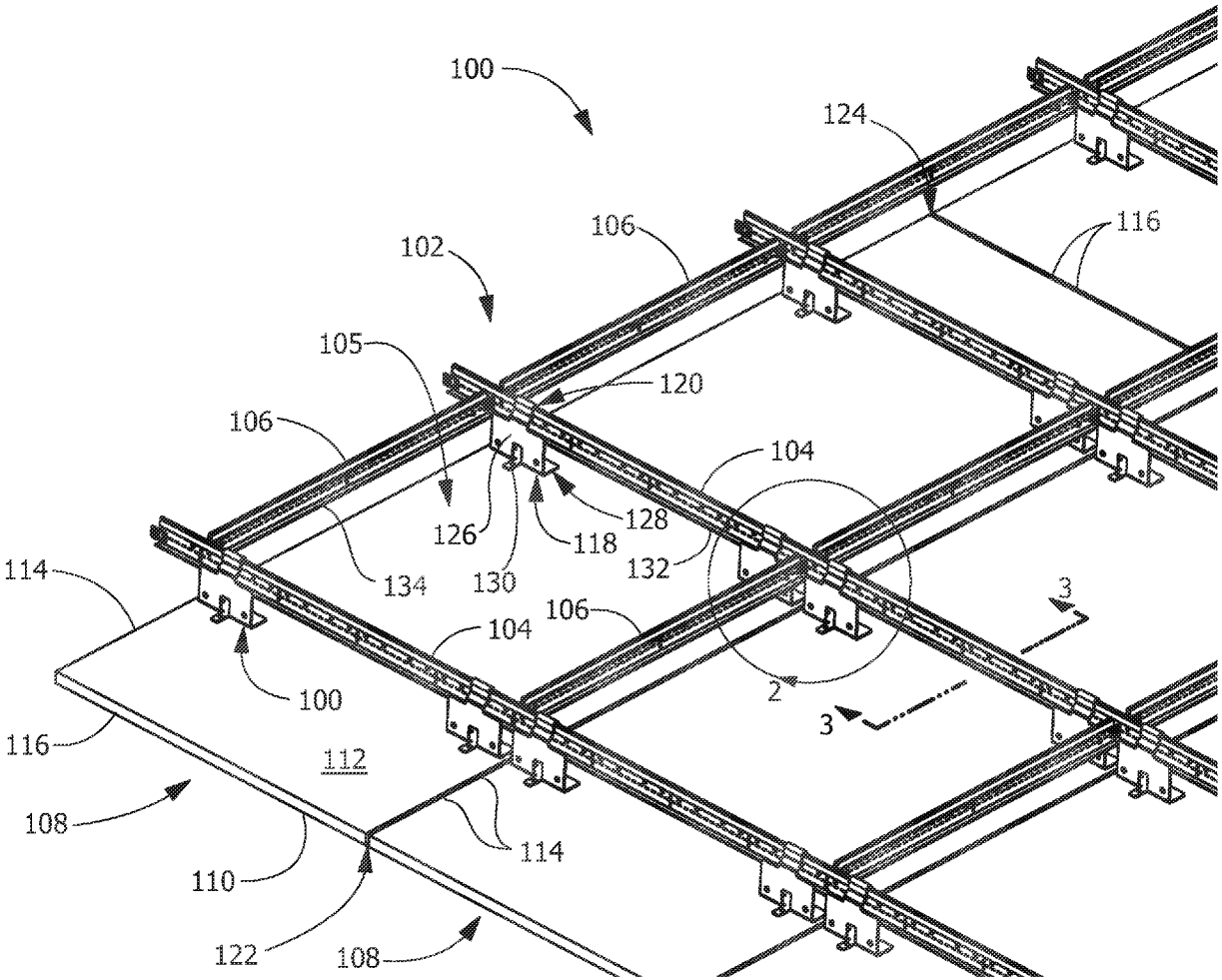
FIG. 1 illustrates a perspective view of an exemplary suspended ceiling system according to an embodiment of the disclosure.

Referring to FIG. 1, in one embodiment, a suspended ceiling system 100 includes a grid system 102 having first members 104 and second members 106. In one embodiment, the grid system 102 is arranged and disposed in a substantially horizontal plane, and the grid system 102 is supported from a structure above by any suitable supports such as rods, cable or wire (not shown), or for example, galvanized steel wire. In one embodiment, the grid system 102 is a 15/16" wide exposed type tee grid of inverted "T" cross-section, or any suitable grid such as an extruded H-bar grid. In one embodiment, the first members 104, or main beams for example, are arranged and disposed in substantially parallel relation to each other. The second members 106, or cross beams for example, are arranged and disposed substantially perpendicular to the first members 104, thereby forming a plurality of grid openings 105.

In one embodiment, the suspended ceiling system 100 includes at least one substrate 108, or panel, for example, which extends below and is supported by the grid system 102. The substrate 108 has an exposed surface 110 and a concealed surface 112, the substrate 108 having first sides 114 and second sides 116 which extend between the exposed surface 110 and the concealed surface 112. In one embodiment, the substrate 108 is arranged, disposed and supported below the grid system 102 a predetermined distance. In one embodiment, the predetermined distance provides that the exposed surface 110 is at least about 2⅞", between about 2⅞" and about 3½", between about 3⅛" and about 3½", or any suitable combination or sub-combination thereof, below the face of the grid system 102 from which supported (see also FIG. 3B).

In one embodiment, no perimeter trim element is available to conceal the suspension on suspended ceiling systems 100 that do not run wall-to-wall, such that all sides of the suspended ceiling system 100 must terminate at a wall or at a bulkhead (not shown) constructed to close off the plenum space above the substrate 108 and to conceal the suspension components and substrate panel edges. The suspended ceiling system 100 conforms to the requirements of the International Building Code and its referenced standards. In one embodiment, the suspended ceiling system 100 must be leveled horizontally to within ¼" in 10'.

In one embodiment, the substrate 108 is fabricated of a relatively heavy material, such as metal or wood, and weighs between about 2.0 pounds per square foot (lbs/sqft) and about 3 lbs/sqft, between about 2.0 lbs/sqft and about 2.25 lbs/sqft, between about 2.25 lbs/sqft and about 2.5 lbs/sqft, between about 2.5 lbs/sqft and about 2.75 lbs/sqft, and between about 2.75 lbs/sqft and about 3 lbs/sqft, or any suitable combination or sub-combination thereof. In one embodiment, because the substrate 108 weighs in excess of 2.5 lbs/sqft, the suspended ceiling system 100 is installed per IBC (International Building Code) Seismic Design Categories D, E, and F. Included in these requirements is the use of stabilizer bars or some other means (not shown) to positively prevent the grid system 102 from separating at the walls (not shown). Additionally, walls or soffits (not shown) that serve to support a substrate 108 edge must be braced to structure (not shown) so as not to allow movement greater than ⅛" when subjected to design lateral force loads.

In one embodiment, the substrate 108 weighs at least about 2.75 lbs/sqft, therefore, the building code requires the substrate 108 be supported by heavy duty type first members 104. The heavy duty type first members 104 are configured to support the weight of the substrate 108 plus any additional ceiling components (not shown) that are not independently supported from the building structure (not shown).

Figure 2:
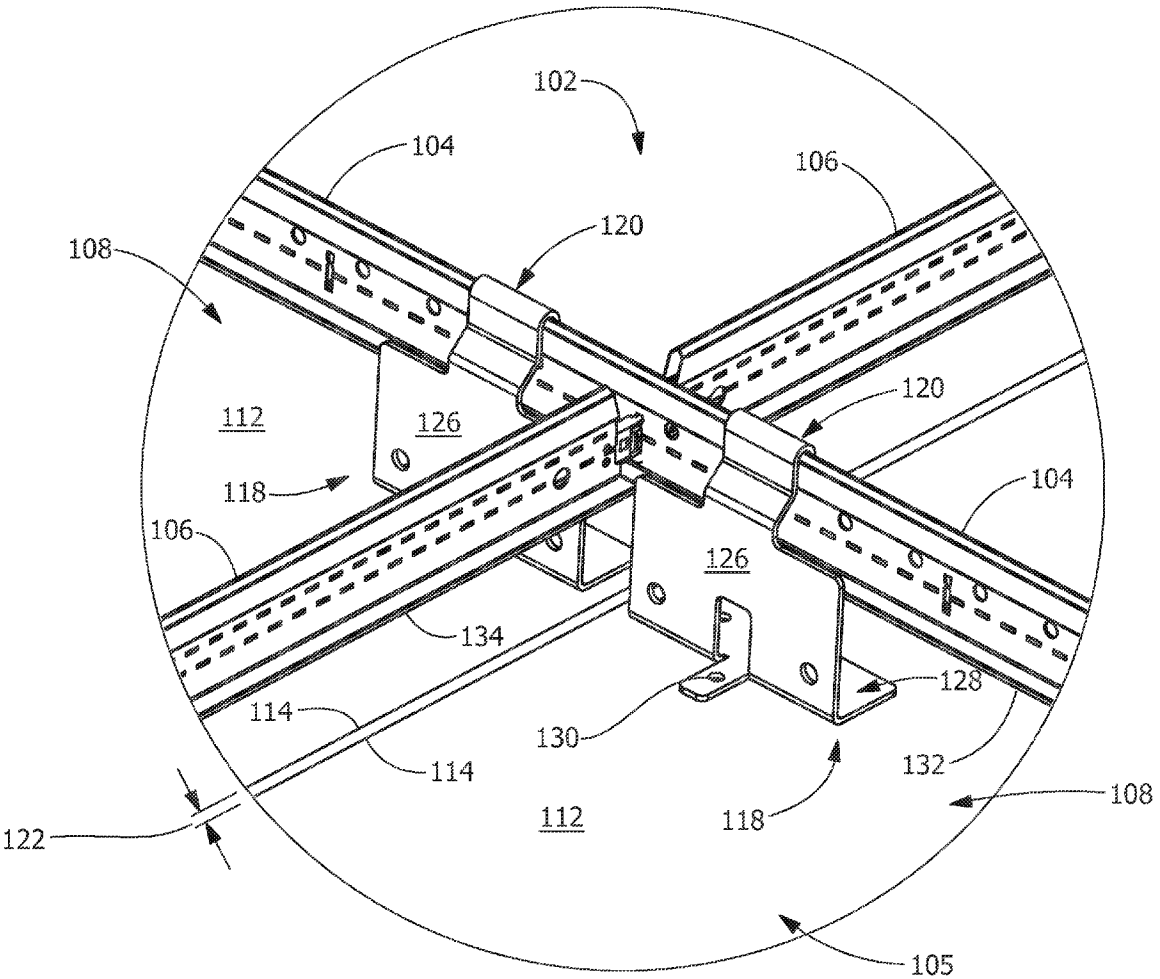
FIG. 2 illustrates an enlarged perspective view of an exemplary suspended ceiling system at a grid member intersection according to an embodiment of the disclosure.

Referring to FIGS. 1 and 2, in one embodiment, the suspended ceiling system 100 includes securing members 118 attached to the concealed surface 112 proximate the first sides 114. In one embodiment, the securing members include a grid engagement member 120, a positioning member 126, and a mounting flange 128. The grid engagement members 120 secure the substrate 108 to the grid system 102. The securing members 118 cooperate with the first members 104 and the second members 106 of the grid system 102 to properly position the substrate 108 to control a first spacing 122 and a second spacing 124 (see FIG. 1) between the adjacent substrate 108. The first spacing 122 is between the first sides 114 of adjacent substrate 108, and the second spacing 124 is between the second sides 116 of adjacent substrate 108. In one embodiment, at least one of the first spacing 122 and the second spacing 124 is about ¼", between about ¼" and about ½", between about ¼" and about ⅜", between about ⅜" and about ½", or any suitable combination or sub-combination thereof.

In one embodiment, the substrate 108 have predrilled attachment apertures (not shown), or predetermined mounting points for example, for mounting the securing members 118 in predetermined locations on the concealed surface 112. In one embodiment, the mounting points are relocated as needed when the substrate 108 panels must be cut, to provide that the first spacing 122 and the second spacing 124 between adjacent substrates 108 is maintained. In one embodiment, the mounting flange 128 includes mounting apertures 130 configured to align with the attachment apertures in the substrate 108. In one embodiment, securing members 118 are attached to the substrate 108 by fasteners (not shown) which engage the mounting apertures 130 and the attachment apertures, or by other suitable fastening devices. In one embodiment, substrate 108 includes additional structural support members configured to engage the securing members 118. In one embodiment, when the securing members 118 are attached to the substrate 108, the positioning members 126 of the securing members 118 cooperate with and abut an adjacent edge of a flange 132 of the first member 104 (see also FIG. 3B) and an adjacent edge of a flange 134 of the second member 106. In one embodiment, the securing members 118 cooperate with the grid system 102 to align and properly position the substrate 108 relative to the grid system 102 and relative to adjacent substrate 108 to form a predetermined pattern.

In one embodiment, the centerlines of the grid system 102 do not line up directly above with the edges of the substrate 108. In one embodiment, predetermined pattern design provides that the ends of the first members 104 are arranged and disposed about one foot in from the second sides 116 (short sides, for example), of the substrate 108 and then located at about two feet on center. In one embodiment, the predetermined pattern design provides that second members 106 of about two feet in length are arranged and disposed to align substantially parallel to the edges of the first sides 114 (long sides, for example), and substantially centered within the first spacing 122 of the substrates 108. In one embodiment, the grid openings 105 are about two feet by about two feet on center as measured to the centers of first members 104 and second members 106.

In one embodiment, the substrate 108 materials and fabrication meets Forest Stewardship Council (FSC) certification. In one embodiment, the substrate 108 are fabricated of non-perforated or perforated panels that are downward accessible, and are designed to meet different noise criteria required by different applications. In one embodiment, the substrate 108 includes wood panels constructed of wood chips factory bonded together between two layers of real wood veneer finish. In one embodiment, the exposed edges of first sides 114 and second sides 116 are banded with the same veneer finish as the exposed surface 110. In one embodiment, the substrates 108 include safety cables (not shown) to prevent the substrates 108 from falling (to the floor) in the event of loss of grid support.

Figure 3A:
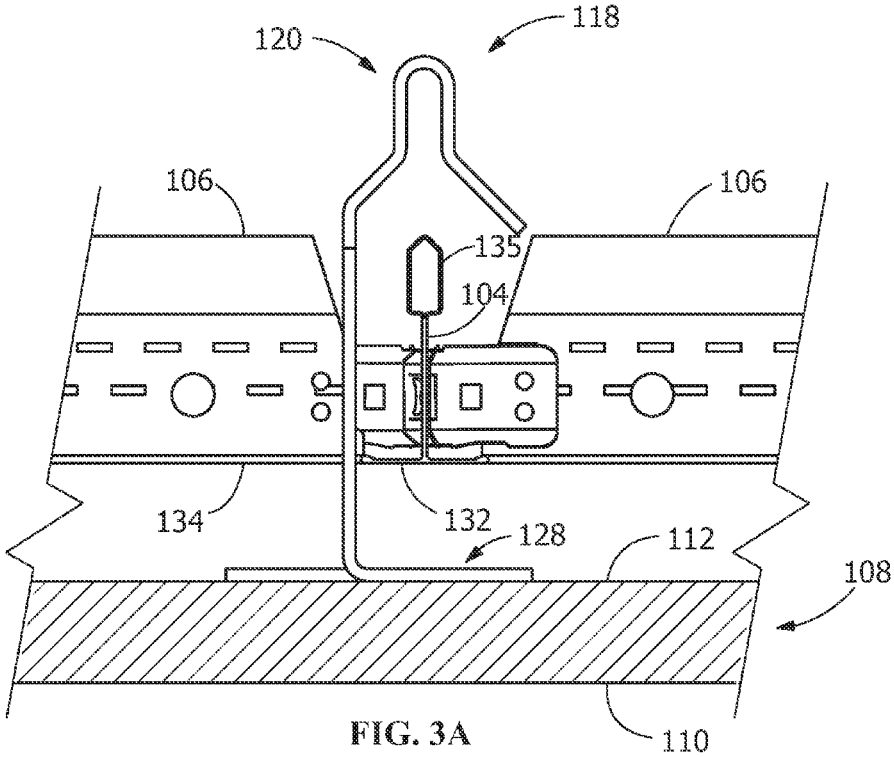
FIG. 3A illustrates a section view of an exemplary securing member in unengaged position relative to the grid according to an embodiment of the disclosure.
Figure 3B:
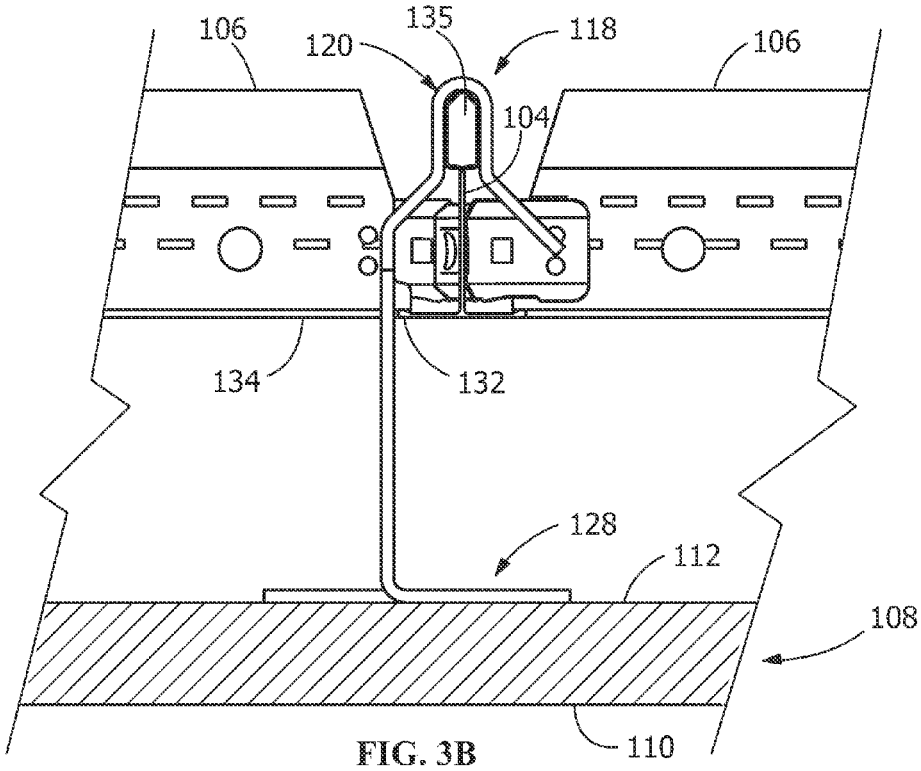
FIG. 3B illustrates a section view of an exemplary securing member in engaged position relative to the grid according to an embodiment of the disclosure.
Figure 4B:
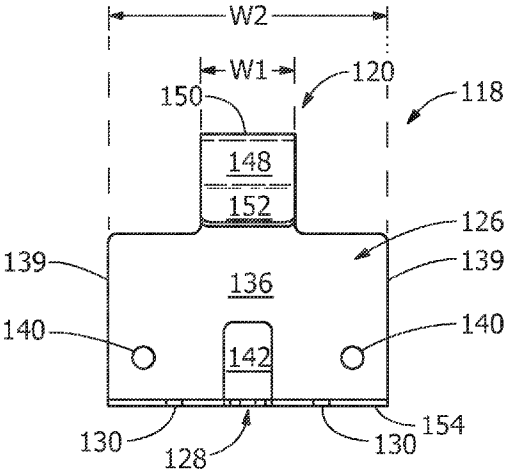
FIGS. 4A-D illustrate perspective, front, side, and bottom views of an exemplary securing member according to an embodiment of the disclosure.
Figure 4D:
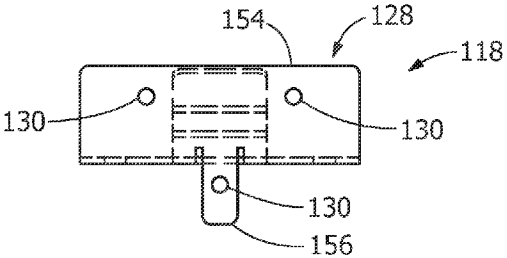
Figure 4A:
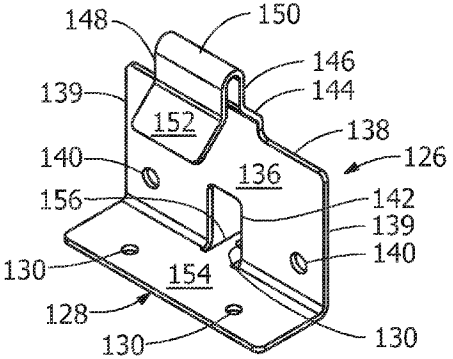
Figure 4C:
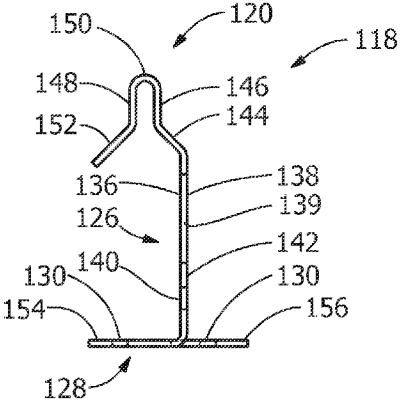

Referring to FIG. 3A, in one embodiment, the securing member 118 (shown attached to the substrate 108) is located in an unengaged position relative to the first member 104 of the grid system 102. In one embodiment, in the unengaged position, the grid engagement member 120 is substantially aligned above a head portion 135 of the first member 104. Referring to FIG. 3B, in one embodiment, the securing member 118 (shown attached to the substrate 108) is located in an engaged position relative to the first member 104 of the grid system 102. In one embodiment, in the engaged position, the grid engagement member 120 engages the head portion 135 of the first member 104, securing and aligning the adjacent substrates 108 into position to form the predetermined pattern.

Referring to FIGS. 4A-D, in one embodiment, the positioning member 126 of the securing member 118 includes a front side 136, a rear side 138, and edge sides 139 disposed on opposite sides of positioning members 126. In one embodiment, the positioning member 126 include apertures 140 for attachment of safety cables (not shown). In one embodiment, the grid engagement member 120 includes a first offset portion 144, a rear arm 146, a clip portion 150, a front arm 148, and a second offset portion 152. The clip portion 150 extends between the rear arm 146 and the front arm 148, and is curved or angled or shaped to coordinate with the shape of the head portion 135. In one embodiment, the clip portion 150, the rear arm 146, and the front arm 148 are all configured to engage and secure the head portion 135 of the first member 104. In one embodiment, the clip portion 150, the rear arm 146, and the front arm 148 elastically deflect to engage the head portion 135 by a friction fit.

In one embodiment, the grid engagement member 120 includes other features or other geometry, such as surface ridges or added material coatings to enhance engagement or gripping of the head portion 135. In one embodiment, the rear arm 146 and the front arm 148 are a predetermined length that allows them to move vertically upward while remaining partially engaged with the head 135. This partial engagement with head 135 allows securing member 118 and substrate 108 to move vertically during seismic conditions without becoming unengaged from the grid system 102. In one embodiment, the first offset portion 144 extends from and is connected at a lower end to an upper end of the positioning member 126, and connects at an upper end to the rear arm 146. The second offset portion 152 connects to and extends from the front arm 148 and assists in alignment of the grid engagement member 120 with the head portion 135. In one embodiment, the front arm 148 is substantially the same length as the rear arm 146. In one embodiment, the combined length of the front arm 148 and the second offset portion 152 is substantially less than or equal to the length of the rear arm 146 to provide a predetermined distance for moving the grid engagement member 120 to reach clearance from the head 135. In one embodiment, alternatively, the grid engagement member 120 does not include the second offset portion 152.

In one embodiment, the width W1 of the grid engagement member 120 is equal to or less than the width W2 of the positioning member 126. In one embodiment, the ratio of the width W1 of the grid engagement member 120 to the width W2 of the positioning member 126 is between about ¼ and about ½, between about ⅓ and about ½, between about ⅓ and about ¾, or any suitable combination or sub-combination thereof. In one embodiment, the longitudinal axis of the grid engagement member 120 is substantially parallel to the longitudinal axis of the positioning member 126.

In one embodiment, the mounting flange 128 includes a front flange 154 and a rear flange 156. The front flange 154 connects to and extends substantially perpendicular from a lower end of the positioning member 126. In one embodiment, the mounting flange 128 includes a cut-out 142 located centrally in the width therein. In one embodiment, the rear flange 156 is formed or punched at the cut-out 142, and extends substantially perpendicular to the positioning member 126. In one embodiment, the rear flange 156 connects to and extends substantially parallel from the front flange 154. In one embodiment, the mounting flange 128 is substantially planar, and the lower surface of the mounting flange 128 engages and is attached to the concealed surface 112 of the substrate 108.

In one embodiment, the rear flange 156 includes at least one of the mounting apertures 130. In one embodiment, the front flange 154 includes at least one of the mounting apertures 130. In one embodiment, the rear flange 156 has at least one mounting aperture 130 arranged and disposed to align substantially with the midpoint of the width W2 of the positioning member 126. In one embodiment, the mounting apertures 130 of the mounting flange 128 provide at least three attachment points to the concealed surface 112, wherein three attachment points are positioned relative one another in a triangular configuration, thereby substantially offsetting any forces applied to the suspended ceiling system 100 which would otherwise result in failure of the connection made by the mounting flange 128 attachment to the concealed surface 112 of the substrate 108.

Figures 5A, 5B, 5C:
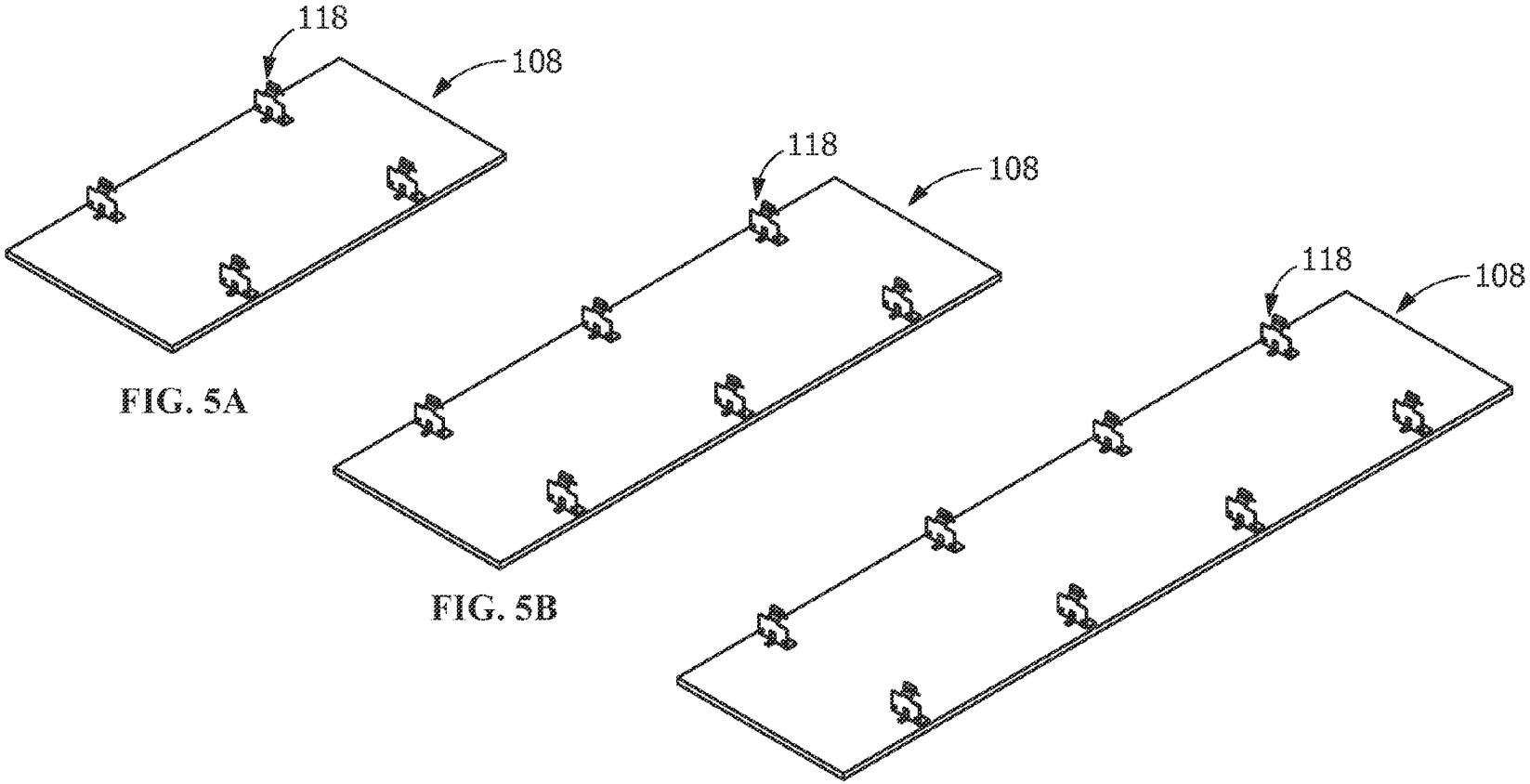
FIGS. 5A-C illustrate perspective views of example substrate panels according to embodiments of the disclosure.

Referring to FIGS. 5A-C, in one embodiment, the substrate 108 are substantially planar with predetermined length by width sizes. In one embodiment, the sizes of the substrate 108 are 2'×4', or 2'×6', or 2'×8', for example. In one embodiment, the weight of a 2'×4' substrate is supported by at least four of the securing members 118 (see FIG. 5A). In one embodiment, the weight of a 2'×6' substrate is supported by at least six of the securing members 118 (see FIG. 5B). In one embodiment, the weight of a 2'×8' substrate is supported by at least eight of the securing members 118 (see FIG. 5C). In one embodiment, each of the securing members 118 are configured to support between about 4 pounds and about 6 pounds of the weight force received from the substrate 108. In one embodiment, the sizes of the substrate 108 are 4'×10', and the weight of the substrate is supported by at least twenty of the securing members 118 (not shown). In one embodiment, the securing members 118 cooperate with the first members 104 and the second members 106 of the grid system 102 to properly position the substrate 108 such that the longitudinal centerline of the substrate 108 aligns substantially parallel to and centered below the middle set of second members 106 and to control a first spacing 122 and a second spacing 124 between the adjacent substrate 108 (not shown).

Figure 6:
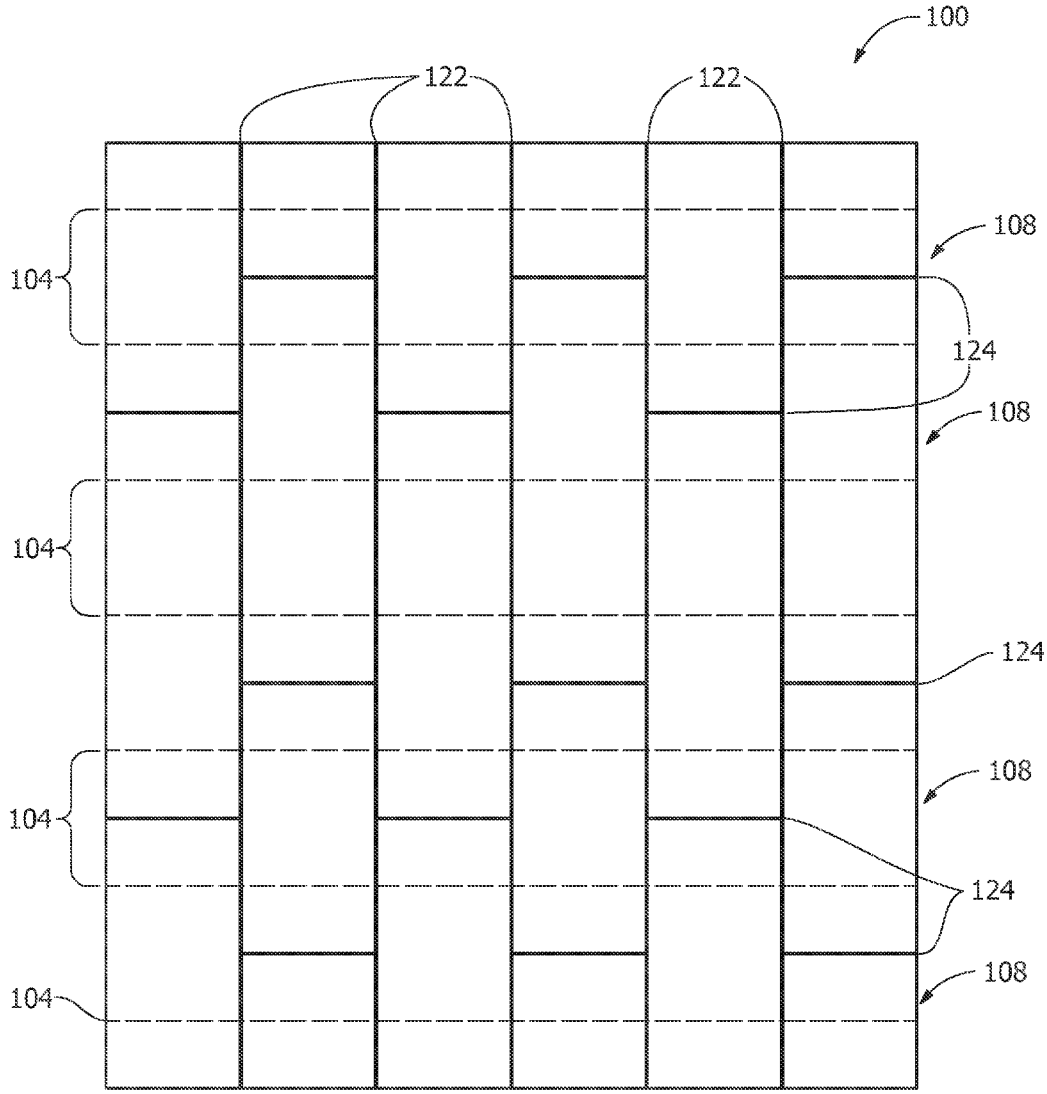
FIG. 6 illustrates a plan view of the exposed side of an exemplary suspended ceiling system according to an embodiment of the disclosure.

Referring again to FIG. 1, in one embodiment, the securing members 118 are configured to secure, support and position each of the substrates 108 to provide that substrates 108 longitudinally adjacent along first sides 114 have adjacent second sides 116 substantially in alignment. In one embodiment, the securing members 118 are configured to secure, support and position each of the substrates 108 to provide that substrates 108 longitudinally adjacent along first sides 114 have adjacent second sides 116 staggered so that their alignment is offset by a distance substantially equal to a multiple of the center to center spacing of first members 104 (see FIG. 6). Referring to FIG. 6, in one embodiment, the securing members 118 positioned on the substrates 108 cooperate with the grid system 102 to allow the staggering of adjacent substrates 108, and/or the use of different sized substrates 108 in creation of a predetermined pattern where the spacing between adjacent substrates 108 is controlled.

In one embodiment, the suspended ceiling system 100 is installed with the first row of the substrates 108 installed with the front side 136 of the securing members 118 facing the edge of the flange 132 of the first member 104 and facing the wall (not shown). Installing a row refers to installing adjacent substrates 108 such that the first sides 114 (or long sides) are adjacent. The substrates 108 are raised such that the second offset portion 152 of the securing members 118 are above the level of the head portion 135 of the grid system 102, and the substrates 108 are moved substantially horizontally toward the edge of the flange 132 and toward the wall (not shown). The substrates 108 are moved into the unengaged position where the grid engagement member 120 of the securing member 118 is substantially aligned above the head portion 135 of the first member 104 (see FIG. 3A). The grid engagement member 120 is lowered onto and engages the head portion 135 of the first member 104. In the engaged position (see FIG. 3B), the grid engagement member 120 engages the head portion 135 of the first member 104, securing and aligning the adjacent substrates 108 into position such that the securing members 118 fit in-between and abutting to the second members 106 and self-align to center the substrates 108 under the grid openings 105 (see FIG. 1). In one embodiment, two safety cables (not shown) are attached at diagonal corners of the substrate 108. The loop ends of the cables are cinched around the first members 104 and connect to the securing members 118 at the other end to one of the apertures 140 on the securing members 118 (not shown).

In one embodiment, the substrates 108 of the middle rows of the suspended ceiling system 100 are installed in the same manner as the first row (not shown). In one embodiment, the substrates 108 of the last row of the suspended ceiling system 100 are installed with the front side 136 of the securing members 118 facing the edge of the flange 132 of the first member 104 and reversed to be facing the ending wall (not shown). In one embodiment, the interior end of the substrate 108 is raised up at an angle and positioned to partially overlap the adjacent substrate 108 of the previous row (not shown). In one embodiment, the substrate 108 is then rotated to a substantially horizontal position until the securing members 118 are adjacent the first members 104 (not shown). The substrates 108 are raised such that the second offset portion 152 of the securing members 118 are above the level of the head portion 135 of the grid system 102, and the substrates 108 are moved substantially horizontally toward the edge of the flange 132 and toward the wall (not shown). The grid engagement member 120 is then lowered onto and engages the head portion 135 of the first member 104 (see FIG. 3B). In one embodiment, two safety cables (not shown) are attached to the substrates 108 similar as described for the first row, except that the cables are attached during installation before the substrates 108 are finally positioned in the suspended ceiling system 100.

In one embodiment, the substrates 108 are removed by lifting substantially vertically to disengage the securing members 118 from the first members 104 (see FIG. 3A). The substrates 108 are then shifted substantially horizontally in the long direction of the substrates 108 to partially overlap the second side 116 (or short side) of the substrate 108 with the second side 116 of the adjacent substrate 108 (not shown). The substrates 108 positioned along the border of the suspended ceiling system 100 will be shifted away from the wall (not shown). The substrates 108 positioned in the center of the suspended ceiling system 100 will only shift in one direction. Once the grid engagement members 120 have cleared the head portions 135 of the first members 104, the substrate 108 is rotated and the free end of the substrate 108 is lowered until the securing members 118 clear the first members 104 (not shown). Once the safety cables are removed from the securing members 118, the substrate 108 is lowered to the floor, as needed (not shown).

Figure 7A:
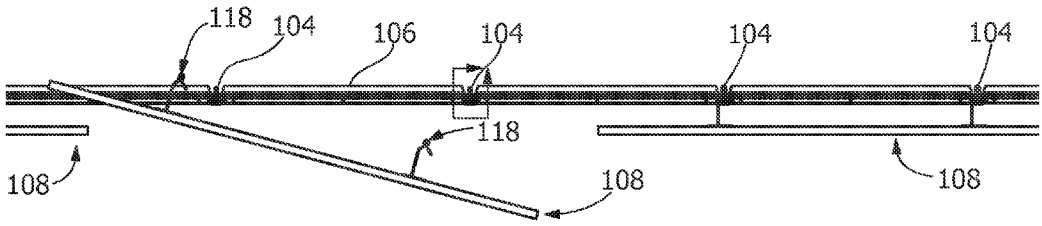
FIGS. 7A-C illustrate section views of an exemplary suspended ceiling system showing reinstallation of an exemplary substrate panel according to an embodiment of the disclosure.
Figure 7B:
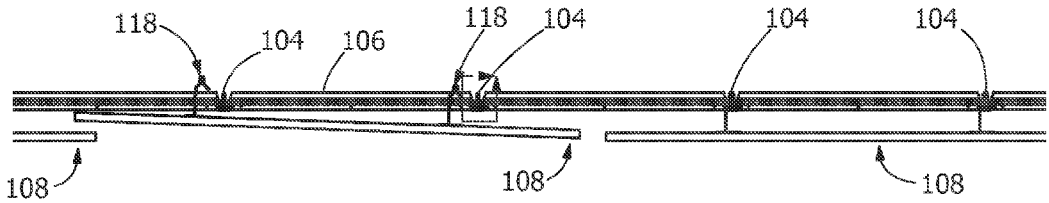
Figure 7C:
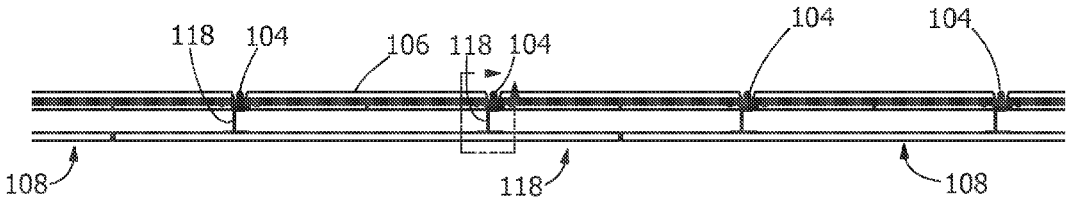

Referring to FIGS. 7A-C, in one embodiment, a re-installation of a replacement substrate 108 is illustrated. In one embodiment, the substrate 108 is positioned with the front side 136 of the securing members 118 facing the edge of the flange 132 of the first member 104 (not shown). Referring to FIG. 7A, in one embodiment, the interior end of the substrate 108 is raised up at an angle and positioned to partially overlap the adjacent substrate 108. In one embodiment, the substrate 108 is then rotated to a substantially horizontal position until the securing members 118 are adjacent the first members 104 (see FIG. 7B). The substrates 108 are raised such that the second offset portion 152 of the securing members 118 are above the level of the head portion 135 of the grid system 102, and the substrates 108 are moved substantially horizontally toward the edge of the flange 132 and toward the wall (not shown). The grid engagement member 120 is then lowered onto and engages the head portion 135 of the first member 104 (see FIG. 7C). In one embodiment, two safety cables (not shown) are attached to the substrates 108 similar as described above for the first row, except that the cables are attached during installation before the substrates 108 are finally positioned in the suspended ceiling system 100.

While the invention has been described with reference to a suspended ceiling system designed to substantially conceal the plenum space above, the self-aligning features and grid system can also be used with exposed plenum designs such as floating ceilings, canopies or cloud panel systems. Additionally, while the invention has been described with reference to a suspended ceiling system using heavier weight substrate panels, the self-aligning features and grid system can also be used with light weight substrate panels weighing under 2.0 lbs/sqft, such as soft fiber panels.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A suspended ceiling system, the system comprising:

a grid system having first members and second members, the first and second members arranged in an intersecting pattern;

at least one substrate which extends below the grid system, the at least one substrate having an exposed surface and a concealed surface, the at least one substrate having first sides and second sides which extend between the exposed surface and the concealed surface;

securing members attached to the concealed surface proximate the first sides, the securing members having grid engagement members which secure the at least one substrate to the grid system, wherein each of the securing members cooperates with both the first members and the second members of the grid system to properly position the substrate;

the securing members further comprising positioning members, the grid engagement members extending from an upper end of the positioning members, the grid engagement members comprising clip portions, the first members of the grid system comprising head portions that slidably nest within the clip portions of the securing members, and the positioning members abutting flanges of the first members and flanges of the second members;

whereby spacing between adjacent ones of the at least one substrate is controlled.

2. The system of claim 1, wherein the first members comprise upstanding walls, the head portions of the first members forming upper edges of the upstanding walls.

3. The system of claim 1, wherein the securing members are attached to the at least one substrate so that the clip portions of all of the securing members attached to the at least one substrate face the same direction.

4. The system of claim 1, comprising a plurality of the substrates secured to the grid system by the securing members in a staggered arrangement.

5. The system of claim 1, wherein the substrate weighs between about 2 pounds per square foot and about 3 pounds per square foot.

6. A securing member for a suspended ceiling system, the securing member comprising:

a grid engagement member configured for securing to a grid system, wherein the grid engagement member comprises a clip portion configured to slidably receive a head portion of a first member of the grid system for nesting therein;

a positioning member configured for alignment with the grid system, the positioning member comprising a front side and a rear side opposite the front side, the grid engagement member extending from an upper end of the positioning member;

a mounting flange configured for attachment to a substrate, the mounting flange comprising a front flange extending from the front side of the positioning member and a rear flange extending from the rear side of the positioning member;

wherein the mounting flange includes at least three support points configured in a triangular relation for attachment to the substrate, wherein at least one of the three support points is located on the front flange and at least another one of the three support points is located on the rear flange; and wherein the grid engagement member further comprises a first offset portion coupled to the positioning member and extending oblique to the positioning member, the clip portion coupled to the first offset portion, and a second offset portion coupled to the clip portion and extending oblique to the positioning member.

7. The securing member of claim 6, wherein a longitudinal axis of the grid engagement member is substantially parallel to a longitudinal axis of the positioning member.

8. The securing member of claim 6, wherein the rear flange is formed from a portion of the positioning member via punching.

9. The securing member of claim 6, wherein the ratio of the width of the grid engagement member to the width of the positioning member is between about ¼ and about ½.

10. The securing member of claim 6, wherein the securing members are configured to support between about 5 pounds and about 6 pounds of weight force received from the substrate.

* * * * *